US005842521A

United States Patent [19]

Tetzlaff et al.

[11] Patent Number: 5,842,521

[45] Date of Patent: Dec. 1, 1998

[54] DOWNHOLE PRESSURE RELIEF VALVE FOR WELL PUMP

[75] Inventors: Steven K. Tetzlaff, Huntington Beach; Stephen T. Shanahan, Whittier; David B. Dillon, Laguna Nigel, all of Calif.

[73] Assignee: Baker Hughes Incorporated, Houston, Tex.

[21] Appl. No.: 790,945

[22] Filed: Jan. 29, 1997

[51] Int. Cl.[6] ..... E21B 34/08; E21B 43/12

[52] U.S. Cl. ..... 166/369; 166/68.5; 166/105; 166/322; 166/325

[58] Field of Search ..... 166/369, 370, 166/373, 68.5, 105, 106, 321, 322, 329

[56] References Cited

U.S. PATENT DOCUMENTS

| | | | |
|---|---|---|---|
| 2,300,348 | 10/1942 | Dana | 166/304 X |
| 2,644,527 | 7/1953 | Baker . | |
| 3,472,070 | 10/1969 | Chenoweth . | |
| 3,497,004 | 2/1970 | Page, Jr. . | |
| 3,731,742 | 5/1973 | Sizer et al. | 166/375 |
| 3,876,003 | 4/1975 | Kislong, III | 166/387 |
| 4,009,756 | 3/1977 | Zehren | 166/106 X |
| 4,049,057 | 9/1977 | Hewes | 166/325 X |
| 4,320,800 | 3/1982 | Upchurch | 166/106 |
| 4,441,558 | 4/1984 | Welch et al. | 166/317 |
| 5,183,115 | 2/1993 | Gano . | |

FOREIGN PATENT DOCUMENTS

| | | |
|---|---|---|
| 1542306 | 6/1976 | United Kingdom . |
| 2289488 | 11/1995 | United Kingdom . |

*Primary Examiner*—George A. Suchfield
*Attorney, Agent, or Firm*—James E. Bradley

[57] ABSTRACT

A well pump assembly has a pressure relief valve in the tubing string for avoiding excessive discharge pressure on a progressing cavity pump. The pressure relief valve is mounted in the string of tubing downstream of the pump. The valve assembly has a main flow passage through it for fluid being pumped by the pump through the tubing. The valve assembly has a valve seat and a spring-biased valve element which is urged by the spring against the downstream end of the valve seat to maintain the valve seat closed. The upstream end of the valve seat is in communication with the pressure in the tubing. If the tubing pressure exceeds a selected level, the valve element moves to an open position, discharging well fluid into the casing.

15 Claims, 3 Drawing Sheets

DOWNHOLE PRESSURE RELIEF VALVE FOR WELL PUMP

TECHNICAL FIELD

This invention relates in general to submersible well pump installations and particularly to a downhole wireline retrievable pressure relief valve for a progressive cavity pump.

BACKGROUND ART

One type of well pump in use is a progressing cavity pump. A progressing cavity pump has an elastomeric stator containing double helical cavities along its length. A metal rotor with a helical contour rotates within the stator in an orbital motion. This produces pumping action for pumping fluids.

In one type of installation, the progressing cavity pump is located at the lower end of a string of tubing which is suspended within casing from a wellhead. The pump is driven by a downhole electrical motor and discharges well fluid through the tubing that flows to the surface. The wellhead at the surface has various valves for controlling the well.

This type of pump will become damaged if the discharge pressure becomes too high. That is, if the tubing becomes restricted such as one of the wellhead valves being inadvertently closed, the pump will not be able to pump against this closed valve without damage occurring. As a result, pressure relief valves are installed on the surface for relieving the pressure in the tubing if it exceeds a selected maximum. While workable, disposal of the well fluid discharged out the pressure relief valve needs to be handled. Additional piping for the pressure relief valve and the disposal is needed. The piping is subject to leakage and adds expense to the assembly.

A hydraulically operated valve for draining the tubing of well fluid has also been utilized at the lower end of the string of tubing. When the operator wishes to pull the string of tubing, he will open the valve, which causes fluid in the tubing to flow out the lower end of the tubing as the string of tubing is being pulled from the well. This allows the tubing string to be pulled dry. Excess pressure encountered in the tubing will also cause this type of valve to open. However, this type of valve does not move back to a closed position once the excessive pressure problem is removed. In order to again close the valve, the operator has to pull the string of tubing and the pump to the surface. This requires a workover rig and is time consuming. The process of pulling tubing is costly.

DISCLOSURE OF THE INVENTION

In this invention, a progressing cavity pump assembly is installed with a pressure relief valve that is located in the string of tubing which does not require resetting at the surface. The relief valve is located above the pump, preferably near the surface, and contains a valve element that is urged by a spring against a valve seat. When the tubing pressure becomes excessive, the valve element moves to an open position, venting the fluid in the tubing to the casing. When the excessive pressure problem is rectified, and the pressure drops below the preset maximum, the valve will close, enabling production to continue.

In the preferred embodiment, the valve assembly is made up of two main parts, a stationary body and a retrievable valve sub. The body secures into the string of tubing while the tubing is being installed and has a flow passage for flow through the tubing. The body also has a discharge port that leads to the exterior of the tubing. The valve sub and the body have mating stab connector portions. The valve sub contains a valve seat, a spring and a valve element. The valve sub has a profile on its upper end which allows it to be retrieved through the tubing, leaving the valve body downhole. When the valve sub and valve body make up with the stab connector portions, the downstream side of the valve seat will communicate with the discharge port in the valve body.

MODE FOR CARRYING OUT THE INVENTION

Figure 1:
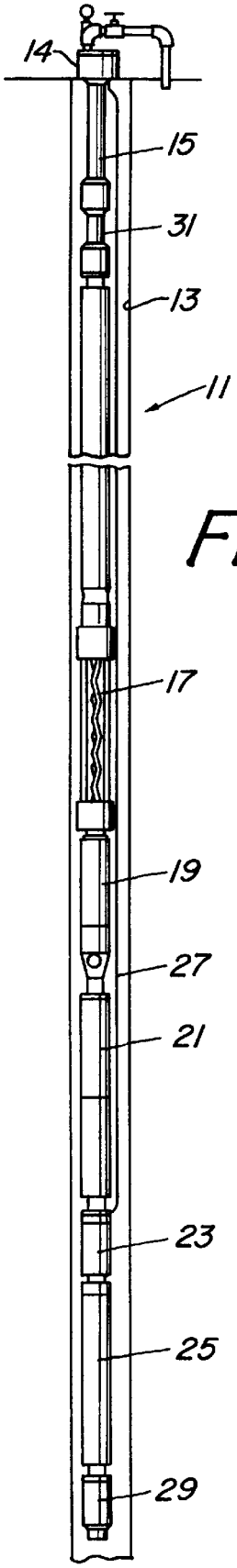
FIG. 1 is a schematic side view, partially sectioned, illustrating a progressing cavity pump assembly constructed in accordance with this invention.

Referring to FIG. 1, well 11 has a casing 13 supported by a wellhead 14 at the surface. A string of tubing 15 is suspended by wellhead 14 in casing 13. A pump 17 is mounted to a lower end of tubing 15. Pump 17 is a conventional progressing cavity type, having a metal helical rotor that is rotated within an elastomeric stator.

An adapter 19 connects the lower end of pump 17 to a seal section 21. A flexible shaft (not shown) is located in adapter 19 for accommodating the orbital motion of the helical shaft of pump 17. Seal section 21 has a thrust bearing (not shown) for absorbing downthrust. A gear reducer 23 locates below seal section 21 and is connected to an electrical motor 25. Gear reducer 23 reduces the speed of motor 25. Motor 25 is filled with a lubricant. Seal section 21 equalizes the pressure of the lubricant in motor 25 with the exterior in casing 13. An electrical power cable 27 extends from the surface alongside tubing 15 for supplying electrical power to motor 25. In the embodiment shown, a pressure and temperature sensor 29 is mounted to the lower end of motor 25. When driven by motor 25, pump 17 will pump fluid through tubing 15 to wellhead 14. If a valve at wellhead 14 is inadvertently closed, the discharge pressure of pump 17 will build, eventually damaging pump 17, unless otherwise relieved. A pressure relief valve 31 is located above pump 17, ideally just below wellhead 14, for preventing the discharge pressure from exceeding a selected maximum. Pressure relief valve 31 will vent pressure to the exterior of tubing 15 within casing 13.

Figure 2A:
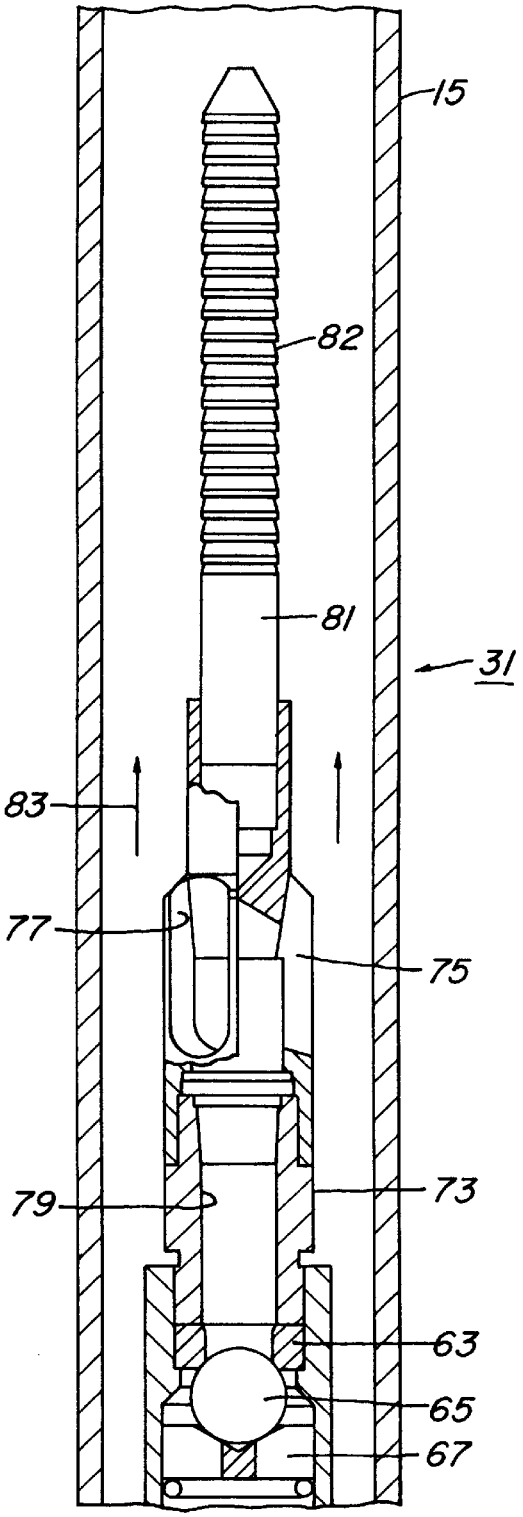
FIG. 2 is an enlarged sectional view of the pressure relief valve portion of the pump assembly of FIG. 1 and showing the valve in a closed position, but not showing the casing.
Figure 2B:
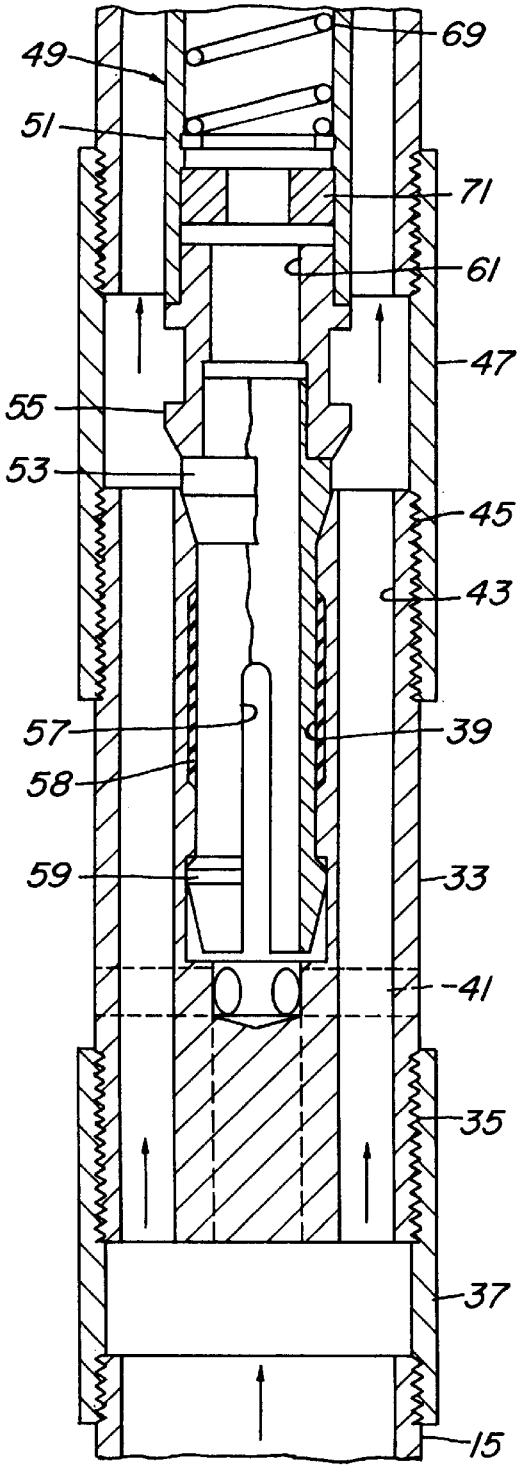

Referring to FIG. 2, pressure relief valve 31 includes a body 33 which is a tubular member having a set of threads 35 on its lower end. Threads 35 secure to a coupling 37, which connects to tubing 15. Body 33 has an axial central receptacle 39 that extends downward from the upper end of body 33, but terminates above the lower end of body 33. Receptacle 39 is a cylindrical bore and serves as one portion of a stab connector. A plurality of discharge passages 41 lead radially from the lower end of receptacle 39 to the exterior of body 33 within casing 13. A plurality of main flow passages 43 extend axially through body 33 from the lower end to the upper end. Main flow passages 43 are offset from and spaced in an array around receptacle 39. Main flow passages 43 allow fluid flowing upward from pump 17 to flow through. Body 33 also has a set of threads 45 on its upper end which secure to tubing 15 through a coupling 47.

Figure 4A:
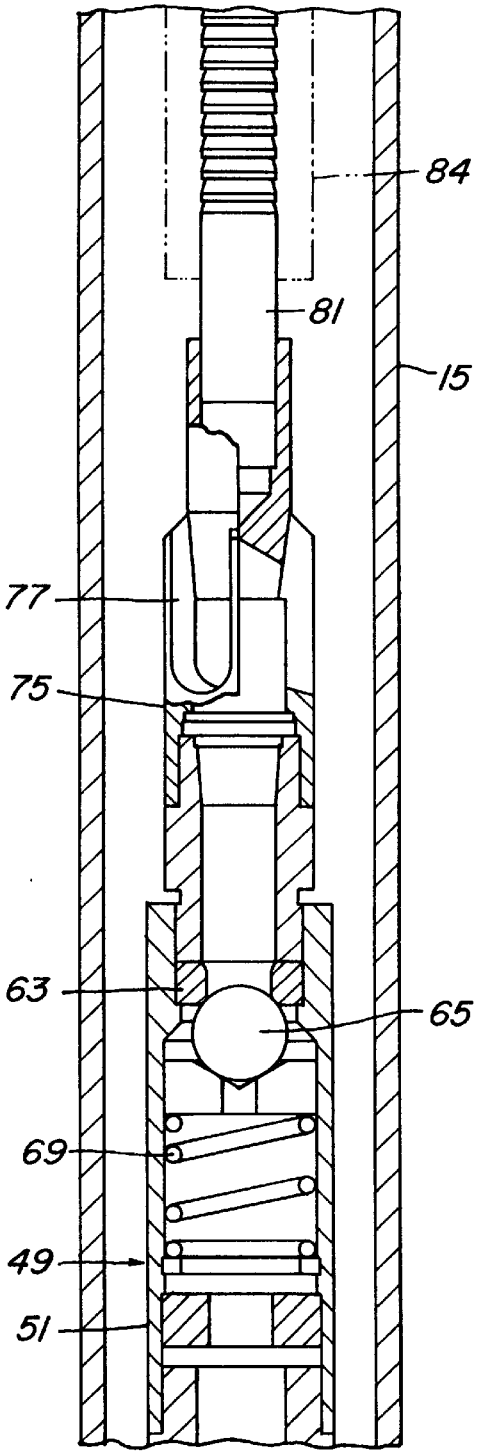
FIG. 4 is a sectional view of the pressure relief valve of FIG. 2, showing the valve sub being retrieved from the valve body, but not showing the casing.
Figure 4B:
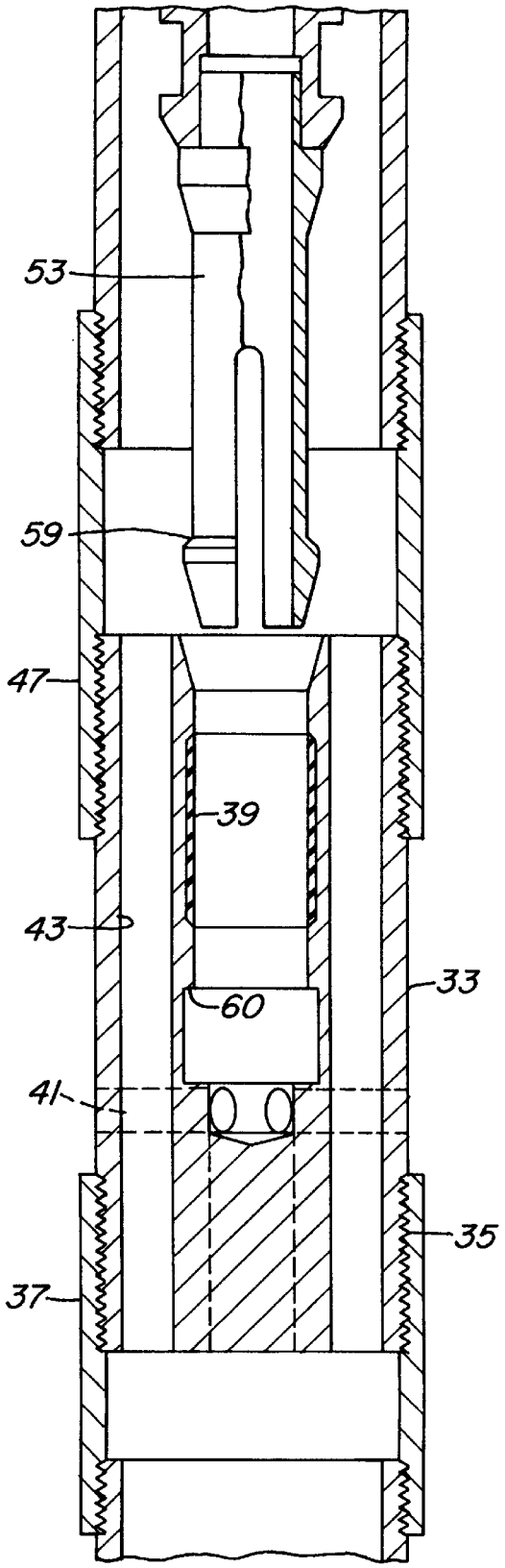

A valve sub 49 forms a second portion of the pressure relief valve assembly. Valve sub 49 includes a tubular member 51 that locates within tubing 15. A mandrel 53 connects to tubular member 51 by an adapter bushing 55 and extends downward. Mandrel 53 is hollow and has slits 57 in its lower end, forming a collet. Mandrel 53 serves as a second portion of a stab connector for tight sliding reception within receptacle 39. A seal 58 seals mandrel 53 to receptacle 39. Mandrel 53 has a locking shoulder 59 near its lower end which snaps into a recess 60 (FIG. 4) located at the base of receptacle 39. A bypass passage 61 extends axially through mandrel 53 and adapter 55.

A valve seat 63 is mounted in an upper portion of tubular member 51. Valve seat 63 has an upstream end which faces upward and a downstream end which faces downward. A valve element or ball 65 engages the downstream end of valve seat 63 to close valve seat 63. Ball 65 is urged upward into engagement with valve seat 63 by a spring 69 which engages ball 65 with a spring retainer 67. An adjusting ring 71 located at the base of spring 69 enables the compression of spring 69 to be changed to provide the desired force.

A tubular plug 73 is secured to the upper end of tubular member 51. Plug 73 has a cage 75 mounted to its upper end which has slots 77 to admit fluid into tubing 15. Slots 77 communicate with a communication passage 79 that extends axially through plug 73. Communication passage 79 leads to the upstream end of valve seat 63.

A fishing neck 81 is mounted to the upper end of cage 75. Neck 81 has a profile 82 on its exterior made up of a plurality of conical grooves. Profile 82 is adapted to be engaged by a running tool 84 (FIG. 4) of a conventional nature. Running tool 84 may be of a wireline type and is shown with dotted lines as it may be of a variety of types and is commercially available.

In operation, the assembly will be installed as shown in FIGS. 1 and 2. During normal pumping, motor 25 will drive pump 17 to cause fluid to be discharged up tubing 15. The fluid flows through main flow passages 43 and through tubing 15 to wellhead 14, as indicated by arrows 83 in FIG. 2. The pressure of the well fluid in tubing 15 at pressure relief valve 31 will be in communication with the upstream end of valve seat 63. This pressure acts through communication passage 79 on ball 65, tending to push it away from valve seat 63 to an open position. Under normal operations, the force of spring 69 is sufficient to prevent ball 65 from moving downward to an open position.

Figure 3:
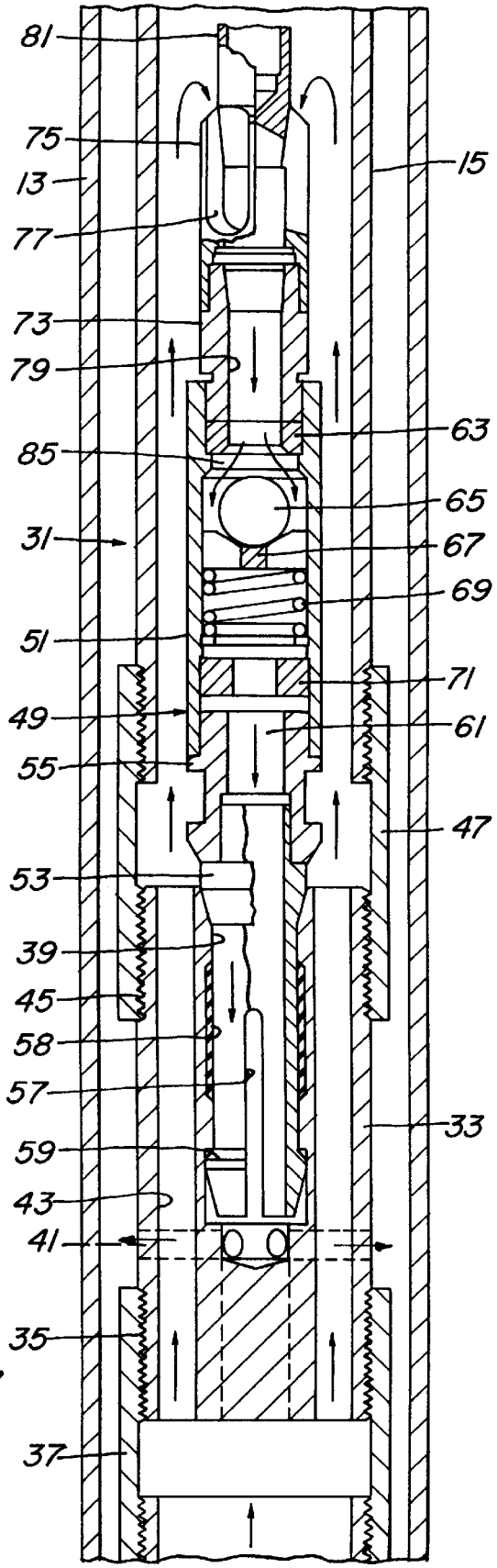
FIG. 3 is a further enlarged sectional view of the pressure relief valve of FIG. 2, showing the pressure relief valve in an open position and showing the casing.

If excessive discharge pressure is encountered, such as due to an inadvertently closed valve in wellhead 14, pump 17 will begin building up the discharge pressure. Referring to FIG. 3, once the force caused by the pressure on ball 65 exceeds the force of spring 69, ball 65 will move to an open position as shown, compressing spring 69. As indicated by the arrows 85, fluid will flow downward through valve seat 63, past ball 65, through bypass passage 61 and out discharge passages 41. The well fluid flows into casing 13 and downward to the level of fluid within casing 13, normally far below. Pump 17 will continue to operate without damage because the pressure will not exceed the selected point at which ball 65 moves to the open position. The fluid will circulate in a loop until the operator discovers and rectifies the problem.

In the event that repairs need to be made to pressure relief valve 31, it is not necessary to pull tubing 15. The operator will connect running tool 84 (FIG. 4) to a wireline (not shown) and lower it into the well. Running tool 84 will slide over neck 81 and engage profile 82. The operator pulls upward with sufficient force to dislodge locking shoulders 59 from recess 60 in receptacle 39. Valve sub 49 is then brought to the surface, leaving valve body 33 downhole. After repair, the operator lowers valve sub 49 back into tubing 15. Mandrel 53 will stab into receptacle 39, locking and sealing valve sub 49 to valve body 33.

The invention has significant advantages. The pressure relief valve limits the discharge pressure of the pump to a safe level. Once the pressure drops below the selected level, the valve automatically closes, allowing production to continue. Unlike surface pressure relief valves, problems are not encountered concerning disposal, because the well fluid simply flows back down the casing. Additional surface piping is not needed with the pressure relief valve. The two portions of the pressure relief valve enable the valve seat and ball components to be pulled to the surface for maintenance without pulling the tubing.

While the invention has been shown in only one of its forms, it should be apparent to those skilled in the art that it is not so limited but is susceptible to various changes without departing from the scope of invention.

We claim:

1. In a well having a string of tubing within casing, a pump secured to the tubing for pumping fluid through the bore of the tubing, an improved pressure relief valve for the pump, comprising:

a valve assembly mounted to the string of tubing downstream of the pump, wherein the tubing string has an axis, the valve assembly positioned substantially in-line with said tubing string axis and having a main flow passage therethrough for conveying fluid being pumped by the pump through the tubing;

a valve seat in the valve assembly, having an upstream end and a downstream end, said valve seat positioned substantially in line with said tubing string axis and the upstream end being in fluid communication with the bore of the tubing;

a spring-biased valve element carried by the valve assembly and urged by the spring against the downstream end of the valve seat to maintain the valve seat closed; and a discharge passage in the valve assembly, in fluid communication with the downstream end of the valve seat and leading to the exterior of the tubing for discharging into the casing fluid flowing through the valve seat in the event that pressure in the bore of the tubing reaches a level to cause the valve element to open the valve seat.

2. The well according to claim 1, wherein the valve assembly comprises:

a body which contains the main flow passage and the discharge passage and which is secured by threads into the string of tubing; and a valve sub which contains the valve seat and valve element, the valve sub being releasably engageable with the body so as to allow the valve sub to be retrieved through the string of tubing.

3. The well according to claim 1, wherein the valve assembly comprises:

a body which contains the main flow passage and the discharge passage and which is secured by threads into the string of tubing, the body having a central receptacle, the discharge passage joining the central receptacle; and a valve sub which contains the valve seat and valve element, the valve sub having a mandrel which inserts sealingly and releasably into the central receptacle, the mandrel having a bypass passage leading from the downstream end of the valve seat for communicating with the discharge passage; and an engaging profile on an upper end of the valve sub for engagement with a tool lowered through the string of tubing from the surface for retrieving the valve sub through the string of tubing for maintenance.

4. The well according to claim 1 wherein the main flow passage and the discharge passage are positioned within the outer diameter of the tubing string and are isolated from each other.

5. The well according to claim 1 wherein the pressure relief valve is positioned within the outer diameter of the tubing string and is located above the pump.

6. The well according to claim 1 wherein the string of tubing has an axis, and the valve element is positioned within the outer diameter of the tubing string and moves axially between open and closed positions.

7. In a well having a string of tubing within casing, a pump secured to the tubing for pumping fluid through the bore of the tubing, an improved pressure relief valve for the pump, comprising:

a body having a longitudinal axis and mounted stationarily into the string of tubing above the pump, the body having an lower end and an upper end, the body having an axial stab connector portion;

a main flow passage extending from the lower end to the upper end of the body for conveying fluid being pumped by the pump through the tubing;

a valve sub having an axial stab connector portion which mates with the axial stab connector portion of the body;

a profile on an upper end of the valve sub for engagement with a wireline tool for lowering the valve sub through the string of tubing and into engagement with the body with the stab connector portions;

a valve seat in the valve sub, having an upstream end and a downstream end;

a spring-biased valve element carried by the valve sub and urged by the spring against the downstream end of the valve seat to maintain the valve seat closed, the upstream end of the valve seat being in fluid communication with the bore of the tubing for applying pressure to the valve element, tending to cause the valve element to move to an open position; and a discharge passage in the body in fluid communication with the downstream end of the valve seat and leading to the exterior of the tubing for discharging into the casing fluid flowing through the valve seat in the event of excessive pressure opening the valve seat.

8. The well according to claim 7, wherein the stab connector portions comprise:

a receptacle in the body, extending axially downward from the upper end of the body; and a mandrel extending axially downward from the valve sub for sliding and sealing reception in the receptacle.

9. The well according to claim 7, wherein the stab connector portions comprise:

a receptacle in the body, extending axially downward from the upper end of the body; and a mandrel extending axially downward from the sub for sliding and sealing reception in the receptacle; and wherein the discharge passage leads from the receptacle to the exterior of the body; and a bypass passage extends through the mandrel to the downstream end of the valve seat for communicating the discharge passage with the downstream end of the valve seat.

10. The well according to claim 7, wherein the valve element moves axially between the open and closed positions.

11. A pressure relief valve for a pump suspended in casing in a well on a string of tubing, comprising:

a body having a longitudinal axis, a lower end and an upper end, the body having threads on its upper and lower ends for securing the body into the string of tubing;

a central receptacle extending axially downward from the upper end of the body;

a main flow passage extending from the lower end to the upper end of the body and offset from the receptacle for conveying fluid being pumped by the pump through a bore of the tubing;

a valve sub having a mandrel which stabs sealingly and releasably into the receptacle;

a profile on the valve sub for engagement with a wireline tool to lower and retrieve the valve sub through the tubing;

a valve seat in the valve sub, having an upstream end and a downstream end;

a spring-biased valve element carried by the valve sub and urged by the spring against the downstream end of the valve seat to maintain the valve seat closed;

an upstream passage in the valve sub leading from the upstream end of the valve seat to the exterior of the valve sub for communicating pressure of the bore of the tubing to the valve element to tend to cause it to open the valve seat;

a bypass passage in the mandrel extending from the downstream end of the valve seat to the exterior of the mandrel for communicating the downstream end of the valve seat with the receptacle of the body; and a discharge passage in the body leading from the receptacle to the exterior of the tubing for discharging into the casing fluid flowing through the valve seat in the event of excessive pressure opening the valve seat.

12. The pressure relief valve of claim 11, wherein the valve element moves axially when moving between the open and closed positions.

13. A method for relieving excess pressure that may occur at a discharge of a well pump suspended on a string of tubing within casing, comprising:

mounting a pressure relief valve in the string of tubing downstream from the pump, the pressure relief valve being positioned within the outer diameter of the tubing string and having a movable valve element urged by a spring against a valve seat;

applying pressure in the string of tubing due to fluid being pumped by the pump to the pressure relief valve; and if the pressure in the string of tubing exceeds a selected amount, causing the valve element to move away from the valve seat, compressing the spring and venting the pressure in the tubing through the pressure relief valve to the casing.

14. The method according to claim 13 wherein the valve element moves back into engagement with the valve seat if the pressure in the string of tubing drops below the selected amount.

15. The method according to claim 14, further comprising continuing to operate the pump while venting the pressure through the pressure relief valve.

* * * * *